US009914195B2

(12) United States Patent
Tassetti et al.

(10) Patent No.: US 9,914,195 B2
(45) Date of Patent: Mar. 13, 2018

(54) SYSTEM OF POLISHING EXTERNAL PIECES FOR A TIMEPIECE

(75) Inventors: Jean-Paul Tassetti, Orchamps-Vennes (FR); Gilles Derriey, Morteau (FR); Patrice Dumont, Villers-le-Lac (FR)

(73) Assignee: Comadur S.A., Le Locle (CH)

( * ) Notice: Subject to any disclaimer, the term of this patent is extended or adjusted under 35 U.S.C. 154(b) by 266 days.

(21) Appl. No.: 14/004,812

(22) PCT Filed: Feb. 17, 2012

(86) PCT No.: PCT/EP2012/052743
§ 371 (c)(1),
(2), (4) Date: Sep. 12, 2013

(87) PCT Pub. No.: WO2012/123215
PCT Pub. Date: Sep. 20, 2012

(65) Prior Publication Data

US 2014/0004777 A1 Jan. 2, 2014

(30) Foreign Application Priority Data

Mar. 16, 2011 (EP) ..... 11158458

(51) Int. Cl.
*B24B 13/02* (2006.01)
*B24B 13/04* (2006.01)
(Continued)

(52) U.S. Cl.
CPC ..... *B24B 13/02* (2013.01); *B24B 13/04* (2013.01); *B24B 29/00* (2013.01); *B24B 47/02* (2013.01); *B24B 47/04* (2013.01); *G04D 3/06* (2013.01)

(58) Field of Classification Search
CPC ..... B24B 13/02; B24B 13/06; B24B 13/01; B24B 11/00; B24B 13/0031
(Continued)

(56) References Cited

U.S. PATENT DOCUMENTS 2,747,339 A * 5/1956 Schelling ..... B24B 13/043 451/277
4,038,783 A * 8/1977 Rosenthal ..... B24B 13/065 451/123
(Continued)

FOREIGN PATENT DOCUMENTS

DE 28 48 772 5/1979
EP 1 645 919 4/2006
(Continued)

*Primary Examiner* — Monica Carter
*Assistant Examiner* — Lauren Beronja
(74) *Attorney, Agent, or Firm* — Oblon, McClelland, Maier & Naustadt, L.L.P.

(57) ABSTRACT

A system of polishing a concave surface of an external piece for a timepiece, including a securing device including a support that carries the piece, and a grinding device including an abrasive mechanism rotatably mounted along a first axis and configured to polish the piece along a first curvature. The securing device further includes a moving mechanism of the support so that the support imparts a back-and-forth motion along a second axis and a contact surface of the abrasive mechanism is curved to polish the piece along a second curvature in addition to the first curvature. The system can be applied to the field of crystals for a timepiece.

15 Claims, 2 Drawing Sheets

(51) Int. Cl.

| | |
|---|---|
| ***B24B 29/00*** | (2006.01) |
| ***B24B 47/02*** | (2006.01) |
| ***G04D 3/06*** | (2006.01) |
| ***B24B 47/04*** | (2006.01) |

(58) Field of Classification Search
USPC ..... 451/7, 41, 277, 255, 240, 256
See application file for complete search history.

(56) References Cited

U.S. PATENT DOCUMENTS

| | | | | |
|---|---|---|---|---|
| 4,510,717 | A * | 4/1985 | Sherwin | B24B 13/00 451/163 |
| 5,720,649 | A * | 2/1998 | Gerber et al. | 451/41 |
| 2003/0129925 | A1* | 7/2003 | Toyoshima | B24B 13/005 451/5 |

FOREIGN PATENT DOCUMENTS

| | | |
|---|---|---|
| EP | 2 228 694 A1 | 9/2010 |
| FR | 1 233 568 | 10/1960 |

* cited by examiner

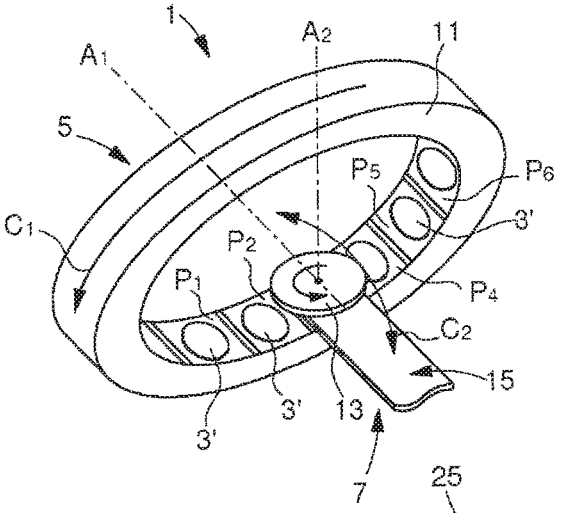
Fig. 1 (Background Art)
Fig. 2
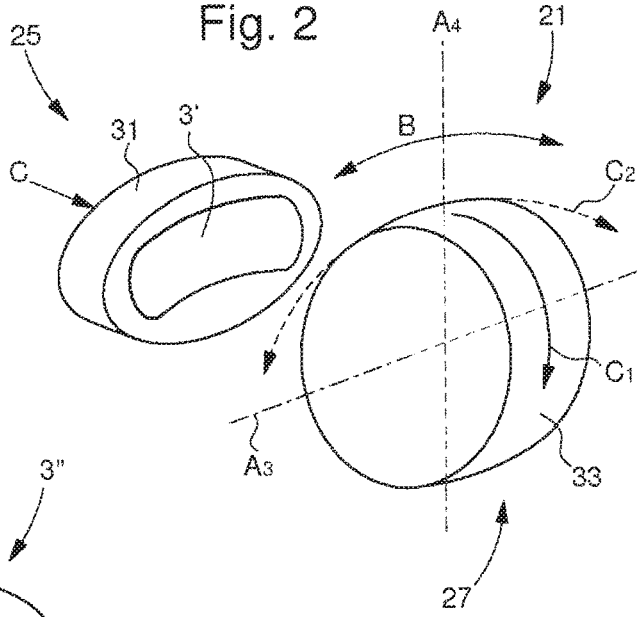
Fig. 3
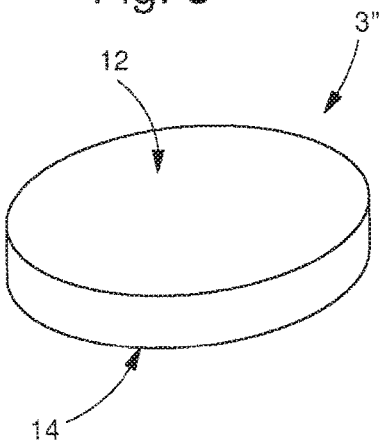
Fig. 4
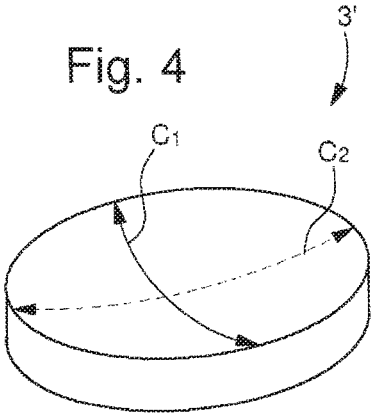

SYSTEM OF POLISHING EXTERNAL PIECES FOR A TIMEPIECE

CROSS-REFERENCE TO RELATED APPLICATIONS

This is a National Phase Application in the United States of International patent application PCT/EP2012/052743 filed on Feb. 17, 2012 which claims priority on European patent application No. 11158458.7 filed Mar. 16, 2011. The entire disclosures of the above patent applications are hereby incorporated by reference.

FIELD OF THE INVENTION

The invention relates to a system of polishing an external piece for a timepiece and in particular the concave surface of a piece of this type.

BACKGROUND OF THE INVENTION

It is known to form sapphire watch crystals which are highly scratch resistant. These crystals are generally manufactured by placing a rotating grinding wheel in contact against the surface of a drum carrying several crystals. The resulting grinding operation enables a cylindrical or spherical crystal to be formed. However, it becomes necessary to form asymmetrical crystals to be fitted, for example, to timepiece displays which are not centred with respect to the timepiece case, which is not possible using current series manufacturing techniques.

SUMMARY OF THE INVENTION

It is an object of the present invention to overcome all of part of the aforecited drawbacks by proposing a piece-by-piece polishing system which does not damage the blanks and allows improved polishing of complex concave surfaces with a very low reject rate.

The invention therefore relates to a system of polishing a concave surface of an external piece for a timepiece comprising a securing device including a support which carries said piece, a grinding device including abrasive means rotatably mounted on a first axis and intended to polish said piece along a first curvature, characterized in that the securing device further includes moving means of the support so that the support imparts a back-and-forth motion along a second axis and in that the contact surface of the abrasive means is curved to polish said piece along a second curvature in addition to the first curvature.

It is thus clear that the polishing is carried out piece-by-piece via the contact of the piece against the abrasive means. The back-and-forth motion of the support thus forces the piece to follow the curved contact surface of the abrasive means. Polishing is thus performed by the movement of the pieces one-by-one against the abrasive means, rotatably mounted along a fixed axis, which provides a very low reject rate by avoiding damage to the rough concave surface before polishing.

In accordance with other advantageous features of the invention:

- the moving means is formed by a rotating actuator driving a crank-shaft which is connected off-centre to a connecting rod integral with said second axis to form said back-and-forth motion;
- the moving means is mounted on a set of selectively movable carriages so as to compel the piece to be polished to exert a force against said abrasive means;
- said first axis and said second axis are substantially perpendicular;
- the abrasive means is formed by a grinding wheel;
- the piece is formed from crystallised alumina.

BRIEF DESCRIPTION OF THE DRAWINGS

Other features and advantages will appear clearly from the following description, given by way of non-limiting illustration, with reference to the annexed drawings, in which:

FIG. 1 is a view of a system of machining blanks according to the invention;

FIG. 2 is a schematic view of a polishing system according to the invention;

FIGS. 3 and 4 are views of a blank at two different manufacturing stages;

DETAILED DESCRIPTION OF PREFERRED EMBODIMENTS

Figure 5:
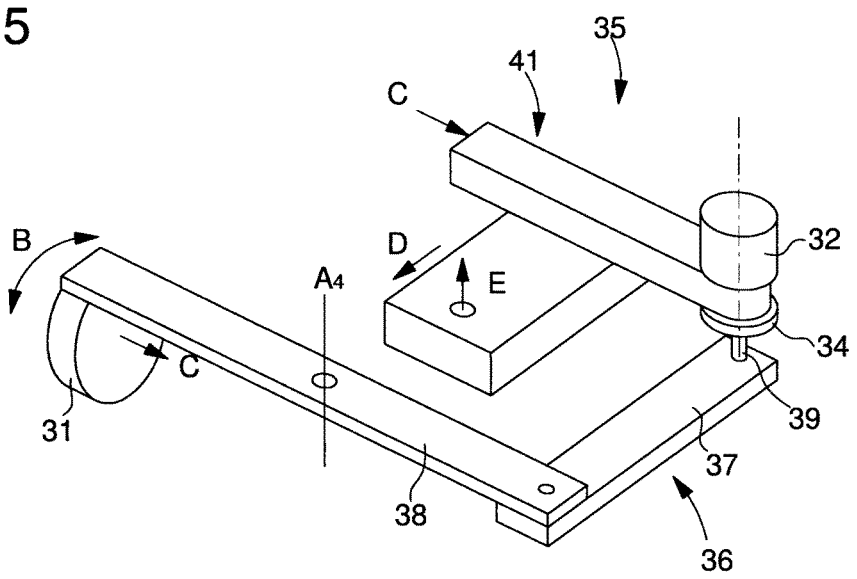
FIG. 5 is a schematic view of the moving means of the securing device according to the invention.

The invention relates to an external piece for a timepiece such as a crystal, case or dial made of crystallised alumina-based material, such as sapphire, corundum or ruby. The invention relates to new manufacturing systems for producing blanks and then polishing pieces of complex shape. Naturally, although the invention was developed for the field of horology, it is not limited thereto. Other applications may also be envisaged such as optics, tableware or electronics.

As illustrated in FIG. 1, a manufacturing system 1 has been developed in order to produce external pieces 3 comprising surfaces whose curvatures $C_1$, $C_2$ are concave. Manufacturing system 1 includes a securing device 5 and a machining device 7.

Securing device 5 includes a drum 11, rotatably mounted along a first axis $A_1$, and carrying at least one blank 3' of the future piece 3. Preferably, as seen in FIG. 1, drum 11 is a ring comprising a facetted inner wall, i.e. provided with successive planes P. As illustrated in FIG. 1, each successive plane $P_x$ receives a blank 3' which may be secured, for example, by bonding.

Machining device 7 includes an abrasive means 13 which is rotatably mounted along a second axis $A_2$ and which is intended to machine each blank 3'. Preferably, abrasive means 13 is moved in the hollow of ring-shaped drum 11. The abrasive means 13 shown in FIG. 1 is formed by a conventional grinding wheel, i.e. whose contact area does not have any particular shape. Of course, abrasive means 13 may be different and, for example, take the form of a curved or conical sabot.

Advantageously according to the invention, the machining device 7 includes moving means 15 of the second axis $A_2$ so that said device is movably mounted along a curved directrix to selectively form a second curvature $C_2$ in each blank 3'. It is thus clear that manufacturing system 1 can form first and second concave curvatures $C_1$, $C_2$.

According to the invention, moving means 15 may, in a non-limiting manner, be formed by an actuator moved back-and-forth against the profile of a fixed cam corresponding to the second curvature $C_2$ or, for example, an automated device programmed to move along said second curvature.

Thus, the first curvature $C_1$ is generated perpendicular to axis $A_l$ by the radius extending between axis $A_l$ and the contact area between abrasive means 13 and each blank 3'. Since drum 11 is moved in rotation along axis $A_1$, each blank 3' is thus hollowed out transversely along a single radius forming the first concave curvature $C_1$.

Moreover, the second curvature $C_2$ is directly obtained by selectively moving the second axis $A_2$. Thus while the first curvature $C_1$ is being generated, the contact area between abrasive means 13 and each blank 3' is gradually moved relative to the thickness of ring-shaped drum 11. Consequently, each blank 3' is hollowed out longitudinally along a curved directrix forming the second concave curvature $C_2$.

It is therefore immediately clear that the curved directrix of moving means 15 may or may not be symmetrical in order to form the second curvature $C_2$ on one or several radii. By way of example, it is possible to start with a blank 3" comprising a top face 12 and a bottom face 14 shown in FIG. 3. After modification by manufacturing system 1, the resulting blank 3' may then include one of these faces 12, 14 with a transverse concave surface comprising a curvature $C_1$ and a longitudinal concave surface comprising a curvature $C_2$.

Finally, preferably according to the invention, the first axis $A_l$ and the second axis $A_2$ are perpendicular so that the machining lines intersect. This feature advantageously facilitates the subsequent polishing of external pieces 3.

Polishing a concave surface like that formed from curvatures $C_1$ and $C_2$ was attempted with tools similar to the system of manufacturing system 1, i.e. mainly by replacing the type of abrasive means. However, this attempt did not provide satisfaction, since this type of polishing caused a deformation of curvatures $C_1$, $C_2$, particularly on the edges of the blanks 3' to be polished and consequently resulted in too high a reject rate.

Consequently, a manufacturing system 21 was developed for pieces of the type 3' illustrated in FIG. 4, namely comprising surfaces whose curvatures $C_1$, $C_2$ are concave. As illustrated in FIG. 2, the manufacturing system 21 includes a securing device 25 and a grinding device 27.

Grinding device 27 includes an abrasive means 33 rotatably mounted along an axis $A_3$ and designed to polish each piece 3' along a first curvature $C_1$. Preferably according to the invention, the contact surface of abrasive means 33 includes a curved surface for polishing piece 3' along a second curvature $C_2$ in addition to said first curvature $C_1$. The abrasive means 33 shown in FIG. 2 is preferably formed by a disc whose grinding surface includes a convex surface, for example made of metal, which is regularly coated with a polishing liquid.

Securing device 25 includes a support 31 which carries the piece 3' to be polished. Preferably according to the invention, the securing device 25 further includes moving means 35 of the support 31 to impart a back-and-forth motion along an axis $A_4$. It should be noted in FIG. 2 that axis $A_4$ is substantially perpendicular relative to the axis $A_3$ of rotation of abrasive means 33.

Thus, moving means 35 enables the blank 3' of piece 3 to be both pressed and to move in order to force the friction of abrasive means 33 against each blank 3' in order to polish said pieces selectively along second curvature $C_2$. It is thus clear that polishing system 21 can polish first and second concave curvatures $C_1$, $C_2$.

According to the invention, moving means 35 enables blank 3' of piece 3 to be pressed and moved relative to abrasive means 33. The moving means 35 will be better understood with reference to FIGS. 5 to 8.

Preferably according to the invention, the moving means 35 is formed by a rotating actuator 32 driving a substantially discoid crank-shaft 34 which is connected off-centre to a connecting rod 36 integral with axis $A_4$ in order to form the desired back-and-forth motion B.

Figure 6:
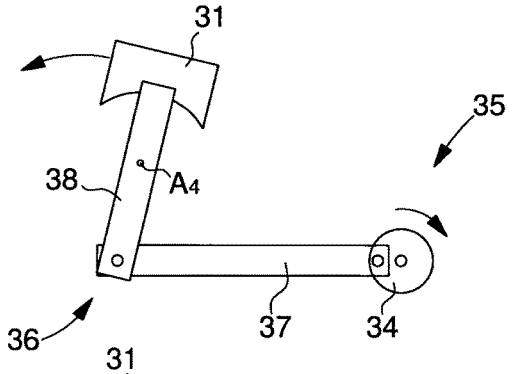
FIGS. 6 to 8 are top views of the moving means of the securing device at various phases of motion.
Figure 7:
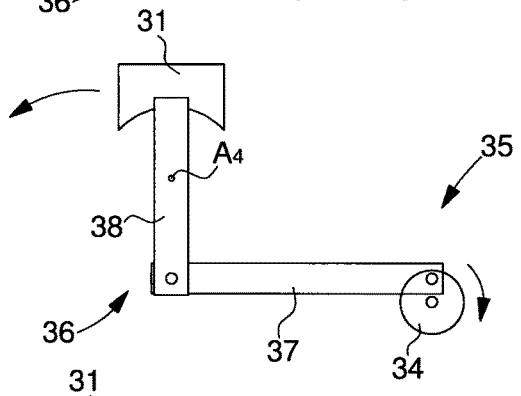
Figure 8:
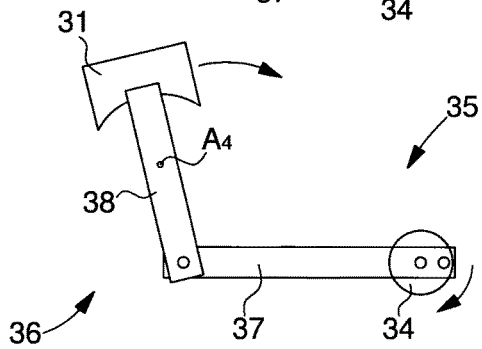

The connecting rod 36 in the example illustrated in FIGS. 5 to 8 includes two arbours 37 and 38. Arbour 37 thus connects the stud 39 of crank-shaft 34, which is off-centre with respect to the axis of actuator 32, to arbour 38. Arbour 38, pivotably mounted along axis $A_4$, connects arbour 37 and support 31. An illustration of motion B is shown in FIGS. 6 to 8.

FIG. 6 shows the moving means 35 in one of the extreme positions of motion B. In this first extreme position, the two arbours 37, 38 of connecting rod 36 form an acute angle with respect to each other. It is thus clear that when crank-shaft 34 imparts a backward rotation, as illustrated in FIG. 6, this causes a trigonometric rotation of arm 38 and, incidentally, of support 31 with respect to axis $A_4$.

FIG. 7 shows moving means 35 in a substantially central position of motion B. In this position, the two arbours 37, 38 of connecting rod 36 form a substantially right angle with respect to each other. It is thus clear that if crank-shaft 34 continues its backward rotation illustrated in FIG. 7, this again causes a trigonometric rotation of arm 38 and, incidentally, of support 31 with respect to axis $A_4$.

FIG. 8 shows moving means 35 in the second extreme position of motion B. In this second extreme position, the two arbours 37, 38 of connecting rod 36 form an obtuse angle with respect to each other. It is thus clear that when crank-shaft 34 imparts a backward rotation, as illustrated in FIG. 8, this causes a backward rotation of arm 38 and, incidentally, of support 31 with respect to axis $A_4$ until the return to the first extreme position passing through the same substantially central position.

Consequently, the rotating motion of actuator 32 is converted by the crank-shaft 34-connecting rod 36 assembly into a back-and-forth motion of support 31.

Preferably according to the invention, the moving means 35 is also mounted on a set 41 of carriages that are moveable selectively longitudinally C, transversely D, and vertically E. This not only enables support 31 to be precisely positioned with respect to abrasive means 33, but also provides the desired pressing action. Indeed, in order to force the piece to be polished via support 31 to exert a force against abrasive means 33, the longitudinal carriage is controlled in a motion C greater than the space between blank 3' of piece 3 to be polished and abrasive means 33.

It is thus clear that polishing is performed piece-by-piece by pressing blank 3' against abrasive means 33, the back-and-forth motion of support 31 forcing blank 3' to follow the curved contact surface of abrasive means 33. Polishing is thus performed by moving a blank 3' piece-by-piece against abrasive means 33 rotatably mounted along a fixed axis $A_3$ which provides a very low reject rate.

The piece 3 obtained after modification of blank 3' by polishing system 21 thus includes one of these faces 12, 14 with a transverse concave surface comprising a curvature $C_1$ and a longitudinal concave surface comprising a curvature $C_2$ which are perfectly polished. Pieces 3 may also be subjected to a final chemical super-polishing step to further improve their appearance.

Of course, this invention is not limited to the illustrated example but is capable of various variants and alterations that will appear to those skilled in the art. In particular, abrasive means 33 may be different and, for example, take the form of a curved or conical sabot.

It is also understood that the moving means 35 may be of a different nature to obtain the same type of pressing action and back-and-forth motions B.

The invention claimed is:

1. A system of polishing a concave surface of an external piece for a timepiece, comprising:

a securing device including a support that carries only the external piece; and a grinding device including an abrasive mechanism formed by a disc rotatably mounted along a first axis to polish the external piece along a first curvature, the disc being substantially cylindrically shaped and including a first face and a second face with a peripheral wall therebetween, an orientation of the disc defined by a plane perpendicular to the first axis and equally dividing the disc;

wherein the securing device further includes a moving mechanism of the support so that the support imparts a repeated, oscillating motion around a second axis that is located within the plane, the external piece remaining in contact with the disc during the repeated, oscillating motion;

wherein a contact surface of the abrasive mechanism formed on the peripheral wall of the disc is curved to polish the piece along a second curvature in addition to the first curvature, and wherein the peripheral wall includes the first curvature and the second curvature.

2. The system according to claim 1, wherein the moving mechanism includes a rotating actuator driving a crank-shaft connected of to a connecting rod integral with the second axis to form a back-and-forth motion.

3. The system according to claim 1, wherein the moving mechanism is mounted on a set of selectively moveable carriages to force the piece to be polished to exert a force against the abrasive mechanism.

4. The system according to claim 1, wherein the first axis and the second axis are substantially perpendicular.

5. The system according to claim 1, wherein the abrasive mechanism includes a grinding wheel.

6. The systemaccording to claim 1, wherein the first curvature is a single concave radius.

7. The system according to claim 1, wherein the second curvature is a symmetrical concave curvature.

8. The system according to claim 1, wherein the second curvature is a non-symmetrical concave curvature.

9. The system according claim 8, wherein the second curvature is famed by plural concave radii.

10. The system according to claim 1, wherein the first curvature is different from the second curvature.

11. The system according to claim 1, wherein the support undergoes an automated back-and-forth motion around the second axis.

12. The system according to claim 1, wherein a radius of the first curvature is measured around the first axis and a radius of the second curvature is measured around the second axis.

13. A system of polishing a concave surface of an external piece for a timepiece, comprising:

a securing device including a support that carries only the external piece; and a grinding device including an abrasive mechanism formed by a disc rotatably mounted along a first axis to polish the external piece alonga brat cruvature, the disc being substantially cylindrically shaped and including a first face and a second face with a peripheral wall therebetween, an orientation of the disc defined by a plane perpendicular to the first axis and equally dividing the disc;

wherein the securing device further includes a moving mechanism of the support so that the support imparts a repeated, oscillating motion around a second axis that is located within the plane, the external piece being ground during the repeated, oscillating motion.

14. The system according to claim 1, wherein the repeated, oscillating motion around the second axis moves the peripheral wall across the support from one extreme position to another extreme position.

15. The system according to claim 13, wherein the, repeated, oscillating motion around the second axis moves the peripheral wall across the support from one extreme position to another extreme position.

* * * * *